United States Patent [19]

Pardo et al.

[11] Patent Number: 4,571,091

[45] Date of Patent: Feb. 18, 1986

[54] FOOD PROCESS AGITATOR

[75] Inventors: Warren A. Pardo, Bel Air; Richard J. Pardo; Valentino Gabriele, both of Baltimore, all of Md.

[73] Assignee: J. C. Pardo and Sons, Baltimore, Md.

[21] Appl. No.: 468,764

[22] Filed: Feb. 22, 1983

[51] Int. Cl.[4] ..... B01F 7/04

[52] U.S. Cl. ..... 366/311; 366/312; 366/313; 366/327

[58] Field of Search ..... 366/311, 312, 313, 67, 366/327, 349, 64, 309, 325, 327, 328, 331; 99/348; 403/324, 341; 384/275, 416, DIG. 3, 441

[56] References Cited

U.S. PATENT DOCUMENTS

| | | | |
|---|---|---|---|
| 415,759 | 11/1889 | Willis | 403/341 |
| 572,965 | 12/1896 | Courtney | 366/309 |
| 1,790,115 | 1/1931 | Sells | 99/348 |
| 1,934,616 | 11/1933 | Steindorf | 384/441 |
| 2,272,715 | 2/1942 | Lindsey | 366/313 |
| 2,580,780 | 1/1952 | Mirshon | 366/312 |
| 2,646,974 | 7/1953 | Read | 366/312 |
| 2,650,807 | 9/1953 | Bilek | 366/312 |
| 2,753,158 | 7/1956 | Rebechini | 366/312 |
| 2,753,161 | 7/1956 | Fye | 366/331 |
| 2,809,021 | 10/1957 | Laden et al. | 366/311 |
| 2,867,997 | 1/1959 | Lake | 366/331 |
| 3,181,840 | 5/1965 | Rietz | 366/311 |
| 3,211,436 | 10/1965 | Butterfield | 366/67 |
| 3,232,210 | 2/1966 | Ogle | 366/325 |
| 3,682,091 | 8/1972 | Bredeson | 99/348 |
| 3,731,339 | 5/1973 | Addison | 366/312 |
| 3,739,710 | 6/1973 | Costa et al. | 99/348 |
| 3,752,057 | 8/1973 | Groen, Jr. | 366/312 |
| 4,095,307 | 6/1978 | Brubaker | 366/311 |
| 4,199,266 | 4/1980 | Giusti | 366/312 |

FOREIGN PATENT DOCUMENTS

| | | | |
|---|---|---|---|
| 1457346 | 12/1970 | Fed. Rep. of Germany | 366/309 |

*Primary Examiner*—Robert W. Jenkins
*Assistant Examiner*—Arthur D. Dahlberg
*Attorney, Agent, or Firm*—Kenneth E. Darnell

[57] ABSTRACT

A mixing agitator for use in a kettle wherein food is mixed either with or without cooking of the food, the invention allows gentle mixing of substantially liquid mixtures to suspend solids uniformly therein without damage to the solids. The agitator preferably takes the form of a rotary shaft horizontally disposed within a kettle having a substantially hemispherical bottom portion, the shaft having contoured blade-like elements attached thereto which act on rotation of the shaft to lift material from the bottom of the kettle to the top of the body of the food and thus produce a uniform dispersion of liquid and solid materials during a cooking/mixing processing phase, a mixing only phase, or a subsequent phase of dispensing the uniformly mixed material from the kettle. The blade-like elements can be provided at free ends thereof with contoured scrapers which are arcuately shaped to conform to localized portions of the bottom portion of the kettle and which in combination act to uniformly scrape the food-contacting walls of the kettle to prevent "burn-on" of certain food materials during a mixing/cooking processing phase.

28 Claims, 12 Drawing Figures

FIG. 1
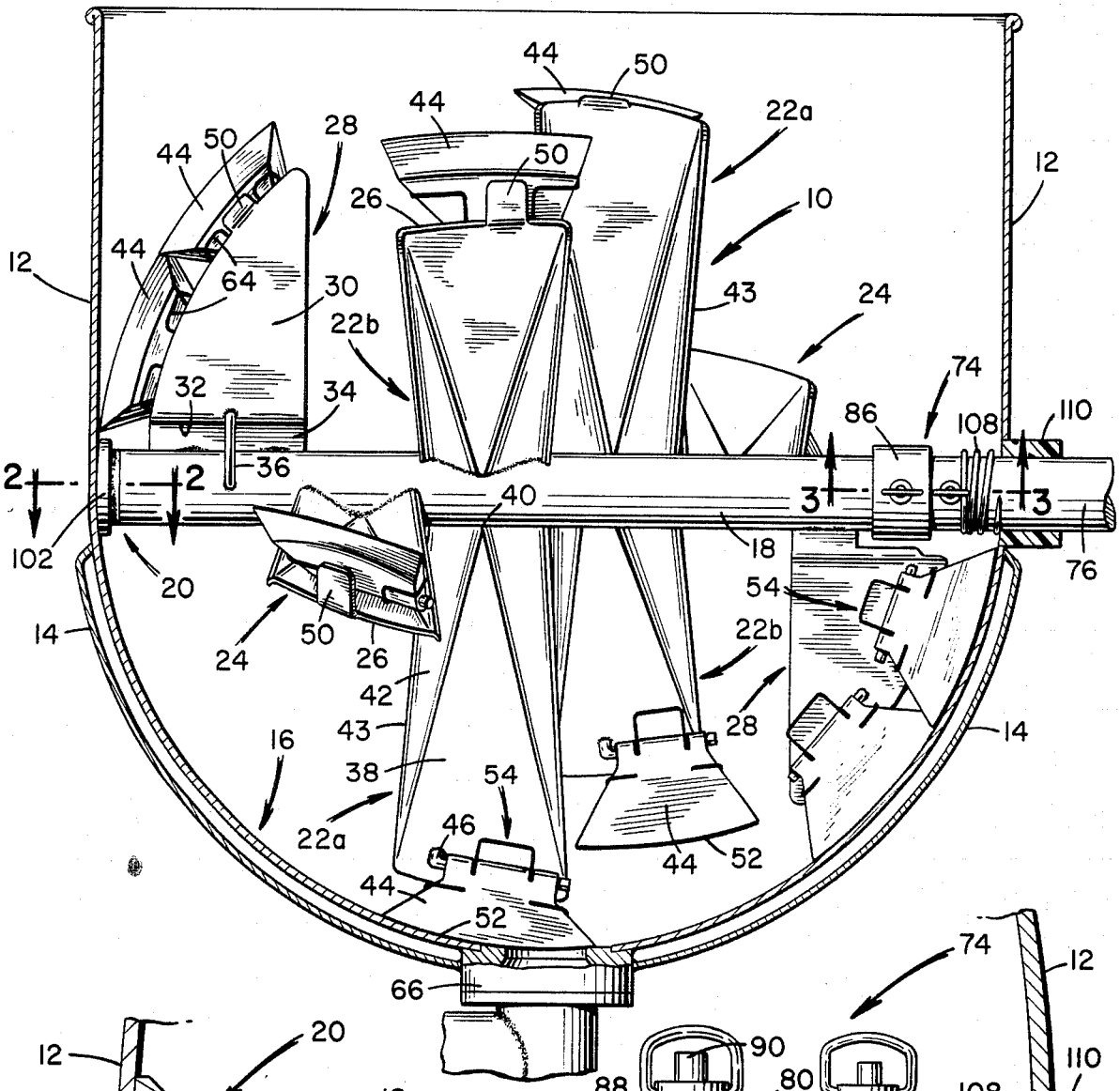
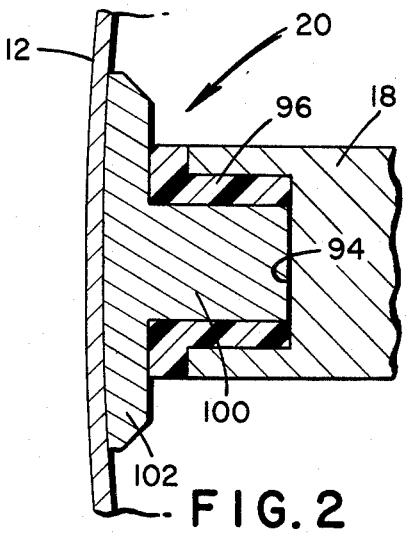
FIG. 2
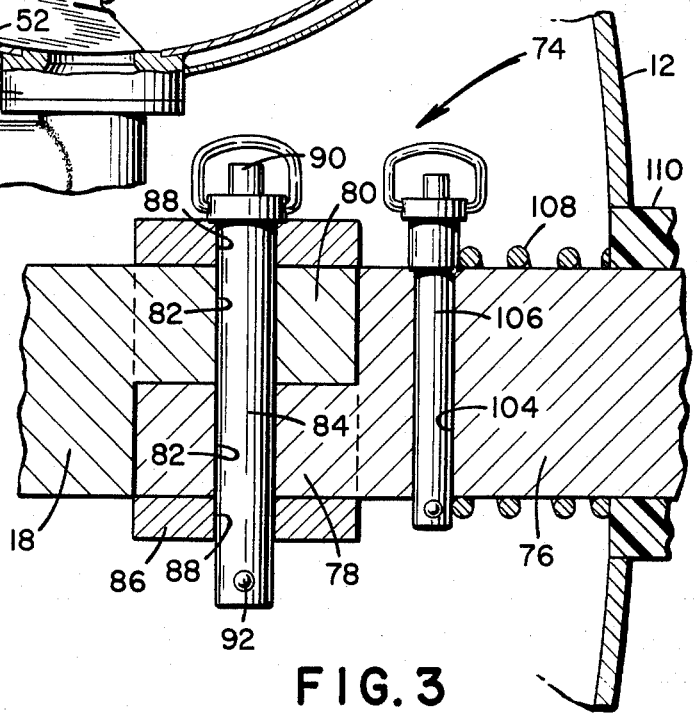
FIG. 3

FOOD PROCESS AGITATOR

BACKGROUND OF THE INVENTION

1. Field of the Invention

The invention relates to the mixing of materials and particularly foods which are shear sensitive, thereby to prevent damage to the foods and to maintain the organoleptic and visual qualities of the food.

2. Description of the Prior Art

Large scale cooking of food such as is necessary in institutional situations and the like has long been accomplished in large cooking kettles, cooking or heating of foodstuffs in such kettles often requiring stirring or mixing operations which occur while the foodstuffs are being heated or cooked. Since mixing or stirring by hand is unreasonably laborious even in the smaller kettles used in hotels, restaurants, health and care facilities and the like, the use of power driven mixers has long been known. Such mixers often take the form of structural elements which merely stir a food or other material which is to be mixed either with or without cooking or heating. Conventional mixing agitators also exist which not only mix food materials being cooked or heated in a kettle, but also scrape the surfaces of the kettle which contact the food materials to prevent the sticking of overheated food materials to surfaces of the kettle which can occur due to localized overheating of the food materials which simple stirring often cannot prevent. Accordingly, mixing agitators having scraper elements which contact food-contacting surfaces of cooking kettles have previously been provided in the art, such mixers acting not only to scrape the walls of the kettle to displace food materials positioned adjacent the walls but which also act to mix and blend the remaining portions of the body of the food materials.

Mixing agitators having scraping capability are disclosed by Groen, Jr. in U.S. Pat. No. 3,752,057, this patent describing a mixer having a shaft which extends into a kettle at an angle of at least 20° with respect to the vertical axis of the kettle. The shaft of Groen, Jr. is provided with a hoop-like structure at the distal end of the shaft, the hoop-like structure having a plurality of scrapers pivotally mounted to said structure at differing inclinations to the axis of the shaft, the scrapers acting to contact surface portions of the kettle in order to prevent food "burn-on" when a food material is being heated within a cooking kettle.

Giusti, in U.S. Pat. No. 4,199,266, describes a mixing agitator having scraping capability wherein a rotary shaft is disposed horizontally within a cooking kettle, the shaft having a substantially circular agitator mounted thereon and wherein the agitator is formed of a pair of substantially annular semicircular blades each having an internal segment-shaped web. The annular blades each carry a plurality of scrapers at their respective peripheries for scraping of internal surfaces of a kettle.

Both the Groen, Jr. and Giusti patents act to move cooking foods from the bottom of a kettle at which location the greatest amount of heat is being directed into the cooking material and lifts the food material to the vicinity of the uppermost portion of the body of the food material, thereby giving that food material near the top of the kettle a chance to flow downwardly and into contact with the heated surfaces of the kettle at the bottom of the kettle. A mixing and blending of the material thus occurs with the scraping of the walls of the kettle being intended to assure that no portion of the food material remains near the cooking surfaces for a time sufficient to cause overheating of portions of the food material.

Examples of other mixing agitators, some of which include scraping elements, are disclosed by Rebechini in U.S. Pat. No. 2,753,158; Hirshon in U.S. Pat. No. 2,580,780; Costa et al in U.S. Pat. No. 3,739,710; and Addison in U.S. Pat. No. 3,731,339. With the exception of the Costa et al patent, the mixers described above do not employ agitators having a vertical axis since such vertical axis agitators must function at high speed to effectively mix certain foods which consist of solid pieces in a liquid base. Operation of such mixers at high speed exerts a substantial shearing affect on the solid materials in such a mixture, thereby resulting in fragmentation and damage to such solid pieces when the solid pieces are of a sensitive nature. Accordingly, in many food mixing situations, mixing at a low speed is necessary in order to prevent physical degradation of the food. Accordingly, a general lifting of food materials near the bottom of a cooking kettle is required in order to prevent damage to shear-sensitive food materials in a mixture which is either being simply mixed or mixed during a cooking or heating process. While agitators including agitators having a scraping capability have been previously utilized in the art as indicated above, such mixing agitators have been intended to be "universal" in operation, that is, such agitators have attempted to be applied to differing applications as diverse as particular mixing needs in food processing, chemical processing, cosmetics mixing, pharmaceutical processing and the like. Agitator structures designed to function in these various applications typically are not well adapted for optimum usage in any of said applications but are typically only barely adequate. The present mixing agitator is particularly designed for use in food processing and is particularly intended for use in the mixing of foods which are being cooked in a kettle such as a steam-jacketed kettle with the foods either having a water base or roux base with thickeners. The scraping capability of the present mixing agitator is particularly necessary for the roux-base materials to prevent "burn-on" during cooking. For those food materials not particularly subject to the burn-on problem or for food materials which need merely to be mixed, the present mixing agitator can be used with or without scraping elements to gently and thoroughly mix such food materials. While the present mixing agitator can be employed in fields other than food processing with performance at least equal to commercially available agitators such as are exemplified by the structures described in the above-noted patents, the present mixing agitator is particularly useful in the food processing field and allows extremely thorough and gentle mixing of food materials including scraping thereof with a relatively simple and inexpensive structure capable of rotating in both clockwise and counter clockwise direction. Further, the present mixing agitator can be rapidly assembled and disassembled in a cooking kettle without the use of tools, thus facilitating cleaning of the agitator and kettle and reducing the time required between cooking of different materials within the same kettle. Accordingly, the present invention provides a mixing agitator which includes a scraping capability and which provides performance, operational and cost advantages over agitators of the prior art.

SUMMARY OF THE INVENTION

The present invention provides a mixing agitator particularly intended for use in the food processing arts and which is primarily intended for use in a cooking or mixing kettle having a substantially hemispherical lower portion. Such kettles when used for cooking or heating of a food material typically have a constant radius in the hemispherical portion which is intended to contain the food materials being heated or cooked. Such kettles are typically provided with a steam jacket for introducing heat to the materials which are to be cooked. Similar kettles are not jacketed but are used for simple mixing and blending. The present agitator is useful with kettles used not only for heating/cooking but also for simple mixing and blending, the scraping capability of the present agitator being particularly important in the heating/cooking process situations. In those situations requiring simple mixing and blending, the scraping elements of the invention are typically not utilized, the agitator itself being capable of providing a gentle lifting, folding and blending of food materials including shear-sensitive materials to allow optimum mixing.

The present mixing agitator is mounted within a kettle with the longitudinal axis of its rotating shaft disposed horizontally, the shaft carrying a plurality of outwardly tapering contoured blades disposed in an angularly offset relation to each other about the rotary shaft. Each blade is contoured on both sides thereof to provide a lifting of solid food materials from the bottom of a kettle regardless of the direction in which the agitator is rotated. In both rotational modes, therefore, the present agitator is capable of gently lifting shear-sensitive food materials from lower portions of a kettle and depositing said materials at upper portions of the food mass without damaging the food or reducing the organoleptic and visual qualities of the food. The present agitator is preferably hydraulically driven to allow continuous torque at variable speeds and to further allow the agitator to be conveniently driven within a speed range of 3 rpms to 30 rpms depending upon the exigencies of a particular mixing application.

The present mixing agitator is further provided with a quick-disconnect shaft arrangement which requires only a single stuffing box and active bearing arrangement at one end thereof, the shaft at the active end being a split shaft capable of being disconnected through a pin and coupling arrangement to allow disassembly of the agitator from the kettle without tools. The agitator can thus be rapidly removed from the kettle for thorough cleaning of the agitator and kettle with a minimum of down-time between disparate cooking operations.

The present agitator thus acts to uniformly stir and mix food by gently bringing food materials up from the bottom of the kettle to the top thereof during a cooking or during a simple mixing operation, thereby guaranteeing a uniform dispersion of food materials, particularly liquid and solid materials, to deliver a uniform product at the end of the cooking or mixing operation. For food materials which are not shear-sensitive, the present agitator can be driven at speeds both with or without scraping to provide aggressive mixing. However, a particular advantage of the present structure is the ability to provide thorough and uniform mixing at low speeds to yield a gentle folding action which obviates damage due to mechanical shear which is often encountered in prior art mixtures with shear-sensitive food components such as meats, seafood, vegetables, pasta or fruits.

It is therefore an object of the invention to provide a mixing agitator having an optional scraping capability and which is capable of completely and thoroughly mixing shear-sensitive food materials without degradation of the food.

It is another object of the present invention to provide a mixing agitator particularly useful in the food processing industry and which includes a horizontally-disposed rotary shaft having tapering scoop-like blades mounted thereto for gentle lifting of food materials disposed within a mass of food which is being cooked or otherwise processed, the scooping and lifting action of the agitator being present regardless of the direction of rotation of the agitator, and wherein the blades can optionally be provided with scraper elements at the free ends of said blades for scraping kettle walls during cooking or heating of foodstuffs having thickeners or other materials which easily locally overheat adjacent kettle surfaces if not periodically removed from the vicinity of the heated kettle surfaces.

It is yet another object of the present invention to provide a mixing agitator horizontally mounted within a kettle and which includes a split-shaft arrangement allowing rapid assembly and disassembly of the agitator to facilitate cleaning of the agitator and kettle within which the agitator is mounted.

It is a further object of the present invention to provide a mixing agitator capable of particular use in the processing of food and which is capable of both gentle and aggressive mixing of food materials either with or without the capability of scraping interior surfaces of a kettle within which food is being processed.

Further objects and advantages of the present invention will become more readily apparent in light of the following detailed description of the preferred embodiments.

BRIEF DESCRIPTION OF THE DRAWINGS

FIG. 1 is an elevational view in partial section of a mixing agitator configured according to the present invention;

FIG. 2 is a detailed elevational view in section of a toe bearing taken along lines 2—2 of FIG. 1;

FIG. 3 is an elevational view in partial section of a split shaft coupling taken along lines 3—3 of FIG. 1;

DESCRIPTION OF THE PREFERRED EMBODIMENTS

Figure 4:
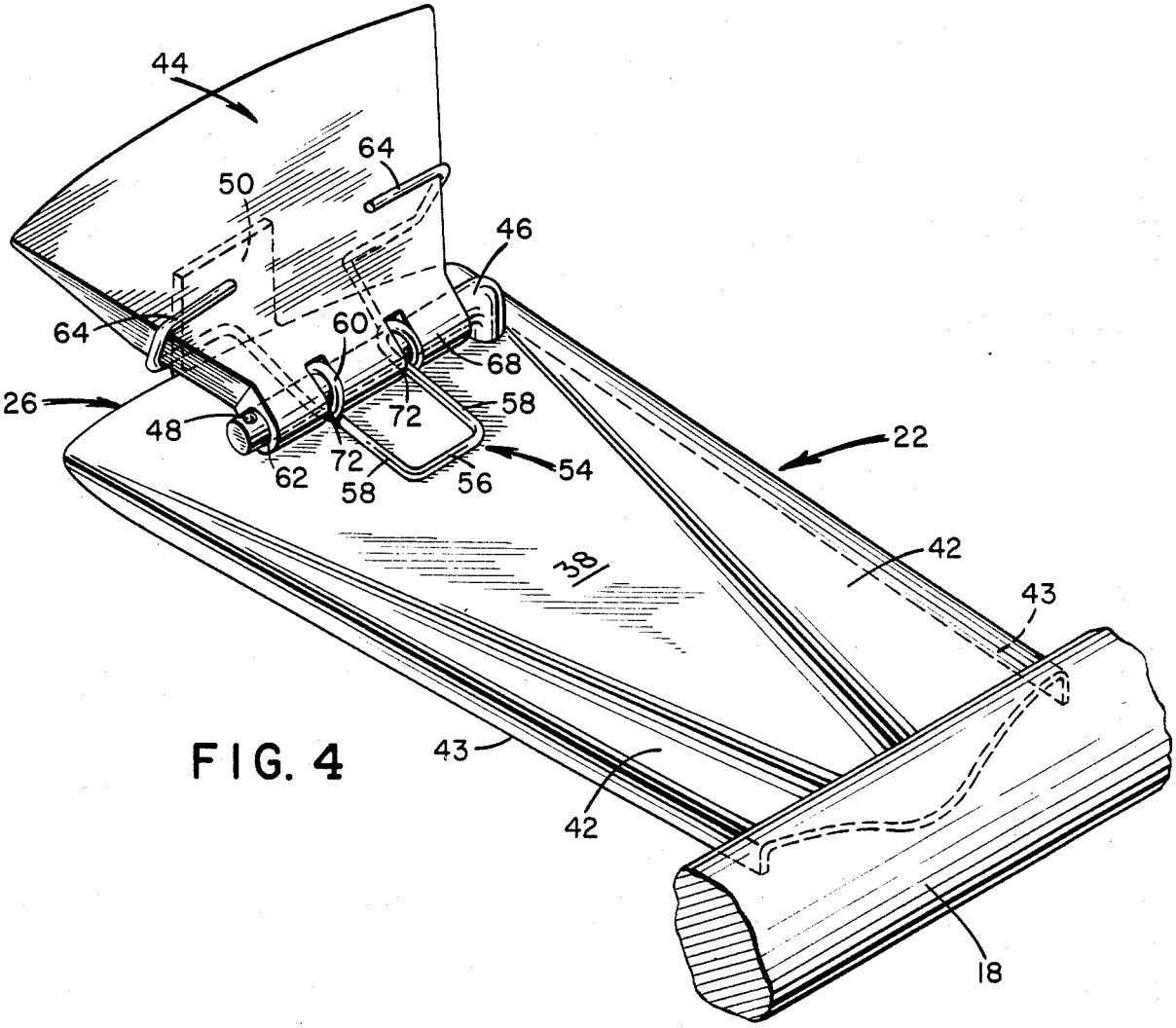
FIG. 4 is a detailed perspective view of an interior scoop-like blade and attached scraping element.

Referring now to the drawings and particularly to FIG. 1, a mixing agitator 10 configured according to a preferred embodiment of the invention is shown to be disposed within a kettle 12 of a type which is conventional in the art. The kettle 12 can be provided with a steam jacket 14 and supporting structure (not shown) of a conventional nature, this additional supporting structure not being shown for convenience of illustration. The kettle 12 is seen to have a hemispherical bottom portion as is conventional in the art, inner walls 16 of the hemispherical portion constituting the primary heating surfaces with which food is brought into contact during a heating or cooking operation occurring within the kettle 12. As will be described in detail hereinafter, the inner walls 16 of the kettle 12 can be scraped to prevent sticking of food due to localized overheating by use of scraping machanisms operable with the agitator 10.

The agitator 10 is seen to comprise rotary shaft 18 which is horizontally disposed within the kettle 12, one end of the shaft 18 being releasably carried by an idler or toe bearing 20 as will be described hereinafter and at the other end of said shaft 18 by a split shaft arrangement connected to bearings externally of the kettle 12 as will also be described hereinafter. It is of importance to note that the shaft 18 is horizontally disposed to facilitate lifting of food materials within the kettle by means of the remaining structural portions of the agitator 10.

Figure 7:
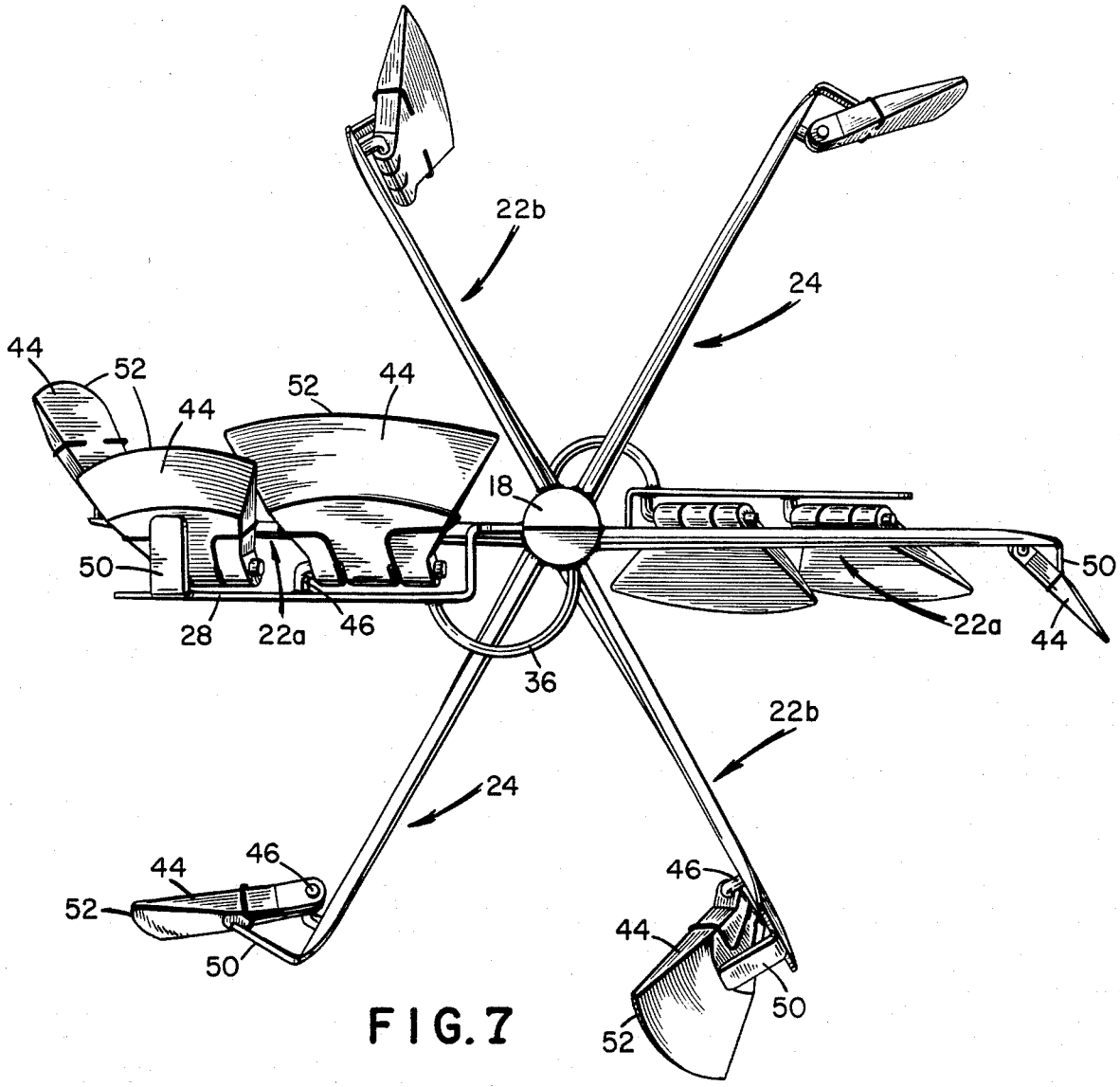
FIG. 7 is an end view of the agitator of FIG. 1 taken along the longitudinal axis of the shaft.

The shaft 18 is seen to carry four interior scoop-like blades 22*a* and 22*b* (referred to collectively herein as the blades 22 or as individual blades 22) and two outermost interior blades 24 which preferably taper slightly from the inner ends which are connected to the shaft 18 toward outer ends 26 of said blades 22 and 24. The outward tapering of the blades 22 and 24 provides an overlap in the volume swept by said blades and contributes to a more thorough mixing of food materials being mixed within the kettle 12. The blades 22 and 24 can best be seen in FIGS. 1 and 7 to be disposed along the shaft 18 in a particular arrangement which, while preferred, is not intended to be limiting of the scope of the invention. In particular, the two outermost interior blades 24 are disposed relative to each other at an angle of 180°, that is, the two outermost interior blades 24 which are respectively disposed at opposite ends of the shaft 18 extend in opposite directions from said shaft 18. Each blade 22*a* is disposed at an angle of 180° relative to the other blade 22*a*. Similarly, each blade 22*b* is disposed at an angle of 180° relative to the other blade 22*b*. The aligned blades 22*a* are offset relative to the aligned blades 22*b*. As best seen in FIG. 7, the blades 22*a* and 22*b* of each radially adjacent pair of blades define a dihedral angle of 120° with the longitudinal axis of the adjacent outermost interior blade 24 bisecting the 120° angle. The three blades 22*a*, 22*b* and 24 on one "half end" of the shaft 18 are mirror images of the other three blades 22*a*, 22*b* and 24 disposed at the other "half end" of the shaft 18 across a plane normal to the shaft 18 medially thereof. It is to be understood that the blades 22 and 24 can be otherwise disposed about the shaft 18 in a regular fashion to provide adequate mixing according to the teachings of the present invention.

As seen best in FIGS. 1 and 7, end blades 28 are disposed at each end of the shaft 18 and extend from said shaft in opposite directions, that is, the substantially flat end blades 28 are disposed at an angle of 180° relative to each other. Further, each end blade 28 is oriented relative to the adjacent outermost interior blades 24 at an angle of approximately 120°. Each of the end blades 28 is seen to be formed of a major planar portion 30 having three sides, two of the sides being straight and intersecting at right angles with the third side being arcuate. Each end blade 28 has a planar web portion 32 which extends normally to the plane of the portion 30 and connects at right angles to a connection web 34 which mounts directly to the shaft 18. An arcuate support 36 may optionally be provided between the planar side of the portion 30 and the shaft 18 to positively mount each blade 28 in place on said shaft 18.

As can best be seen in FIGS. 1, 4, 5, 6 and 7, each of the blades 22 and 24 have a particular conformation which is preferred, each blade 22 and 24 having a substantially triangular interior portion 38 having apex 40 disposed adjacent the connection of the blade to the shaft 18. Rising from each major side of the triangular portion 38 is a lateral portion 42 which recurves at respective edges 43 thereof in the same direction to further form scoop-like hollows or pockets 22 and 24 existing on each side of said blades. Each blade 22 and 24 thus effectively provides a scoop-like surface on each side of said blade thereby allowing the agitator 10 to be rotated either clockwise or counterclockwise and retain the ability to "lift" food materials from the bottom of the kettle 12 and deposit those materials at or near the top of the food mass existing within the kettle 12. The arrangement of the blades also serves to move the food materials from side to side as well as from the bottom of the kettle 12 to the top. Each blade 22 and 24 can be provided with a scraper 44 mounted to said blade by means of a pin 46 which extends laterally across the blade over the planar portion 38, all of the scrapers 44 mounted on the blades being disposed on like sides of said blades. Substantially identical scrapers 44 are mounted to each of the end blades 28 by means of substantially identical pins 46. The pins 46 are provided with spring-loaded ball elements 48 to allow quick release of the scrapers from mounted positions on the pins 46. Stops 50 are mounted at the ends of each of the blades 22 and 24 and adjacent the arcuate outer ends 26 of the blades to provide a detent function, thereby preventing the scrapers 44 from being biased by the food materials beyond a given position, thereby providing relatively low friction scraping of inner walls 16 of the kettle 12. As seen best in FIGS. 8*a* and 8*b*, a recess 51 is formed in the face of the scraper 44 opposing the stop 50 such that the stop 50 extends into the recess 51 to facilitate the detent function. Edges 52 of the scrapers 44 are contoured to fit arcuate surfaces of the inner walls 16 of the kettle 12, the scrapers 44 preferably being formed of a material such as Teflon and being unitarily formed to facilitate cleaning.

Figure 5:
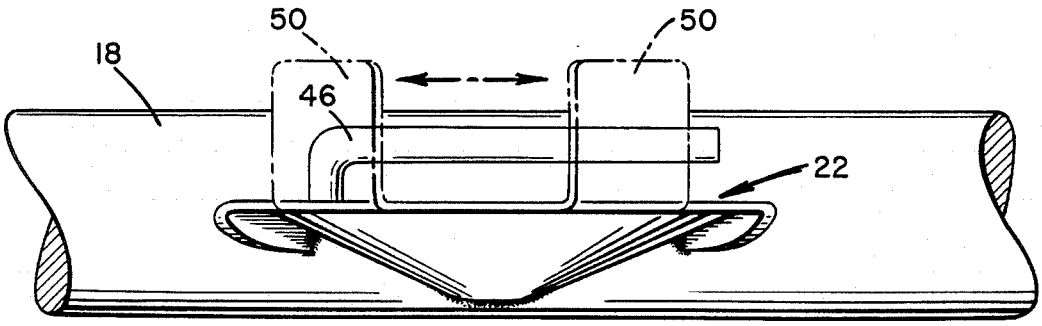
FIG. 5 is a detailed end view of the blade of FIG. 4 without the scraping element and with the variable location of a biasing tab shown in phantom.

As can be seen in FIG. 1, the scrapers 44 on the blades 22, 24 and 28 are mounted at varying angles to the longitudinal axes of the blades in order to facilitate scraping of the inner walls 16 of kettle 12. Further, the longitudinal axes of the pins 46 which mount the scrapers 44 to the blades are turned at slightly varying angles to allow proper positioning of the scrapers 44. The stops 50 and pins 46 are positioned at differing locations on respective blades 22 and 24 to allow an overlap in the paths of the scrapers 44 as the scrapers 44 travel along the walls 16 of the kettle 12. The stops 50 are positioned on certain of the blades 22 or 24 at one side and on certain other of the blades at the other side as is represented in phantom in FIG. 5. On certain of the blades 22 and 24, the stops 50 are intermediate the extreme end position represented in phantom in FIG. 5. FIG. 5 also illustrates the scoop-like hollow or cupping of the blades 22 or 24 which particularly occurs on that side of the blades on which the scrapers 44 are mounted, said side being the preferred surface of said blades to face and move into the food materials being mixed. Such movement of the blades 22 and 24 also provides for scraping of the walls 16 as aforesaid due to the above-described mounting of the scrapers 44 to the "cup" side of the blades 22 and 24.

Figure 6:
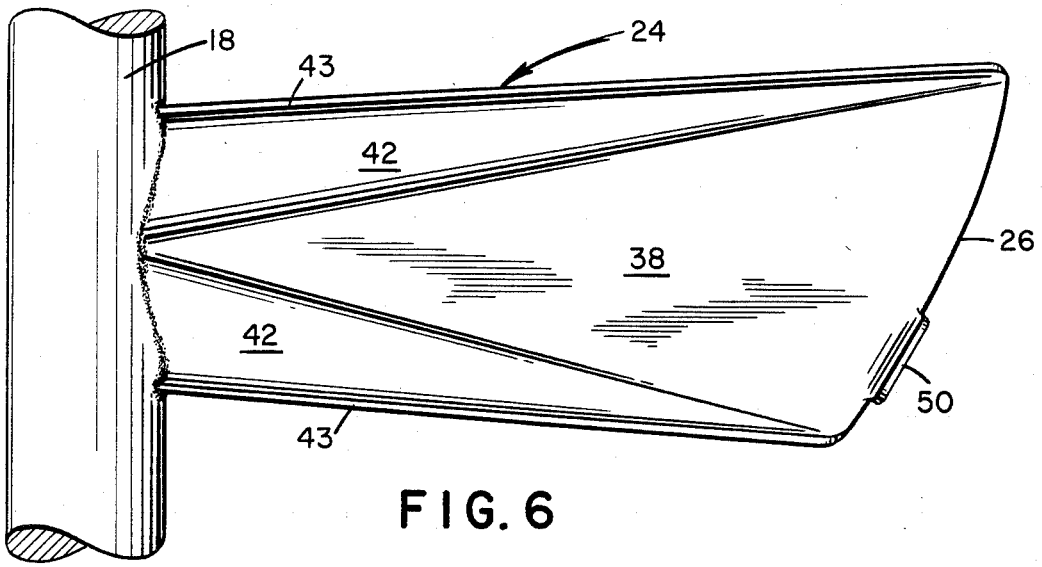
FIG. 6 is a plan view of one of the scoop-like blades which lie between the interior blades of FIG. 4 and the planar end blades.

As can be seen in FIG. 6, the outermost interior blades 24 have a pronounced curvature at the outer ends 26 thereof, this curvature being necessary to confrom to the hemispherical contours of the kettle 12. The stop 50 on the blade 24 is seen to be offset toward the shorter edge in order to be properly positioned relative to the scraper 44 (not shown in FIG. 6) since the scrapers 44 must be offset to allow the necessary overlap as described above.

As can best be seen in FIGS. 1, 4 and 8*a* through 8*c*, the scrapers 44 are provided with springs 54 which hold the scrapers under a desired tension at all times regardless of the size of the kettle 12. Maintenance of the scrapers 44 under tension forces the scrapers into a desired contacting relation with the inner walls 16 of the kettle 12 and acts to compensate for wear simultaneously. Each spring 54 is seen to have a bight portion 56 which contacts the planar portion 38 of each blade 22 or 24 or a planar body portion of each blade to push thereagainst. The bight portion 56 curves at the end of each spring leg 58 in a circular manner to form substantially circular portions 60 within which the pin 46 is received in alignment with channel 62 formed in each of said scrapers 44. Beyond the curved circular portions 60 of the spring 54, the body of the spring extends outwardly and along the body of the scraper 44 to a point approximately halfway along said scraper 44 whereupon each such extension of the spring 54 extends outwardly of the body of the scraper 44 and curves about side edges of said scraper whereupon distal ends 64 of the spring 54 fit against planar facing surfaces of the scrapers 44. Optionally, grooves (not shown) can be formed in the body of the scraper 44 on eitherside thereof to receive the distal ends 64 of the spring to positively maintain the spring 54 in position relative to the scraper 44 even when the scraper 44 and spring 54 are removed as a unit from the mounting pin 46. Thus, the scrapers 44 can be removed from the blades 22, 24 and 28 without the need for tools to allow cleaning of the agitator 10 or to allow use of the agitator 10 without scraping of the inner walls 16 of the kettle 12. The scrapers 44 are thus maintained in forced contact with the inner walls 16 of the kettle 12 by means of the springs 54, thereby to prevent a "burning on" of foodstuffs when food is heated or cooked within the kettle 12. The blades 22, 24 and 28 in combination with the scrapers 44 act to thoroughly mix foods heated within the kettle 12 and to scrape inner walls 16 of the kettle 12 without damaging shear-sensitive food materials even when the food materials are cooked in small batches or are brought into repeated contact with either an open or closed drain valve 66 (see in FIG. 1) as can be provided in the kettle 12 for convenience of removing food materials therefrom on completion of a mixing and/or cooking process.

Figure 8A:
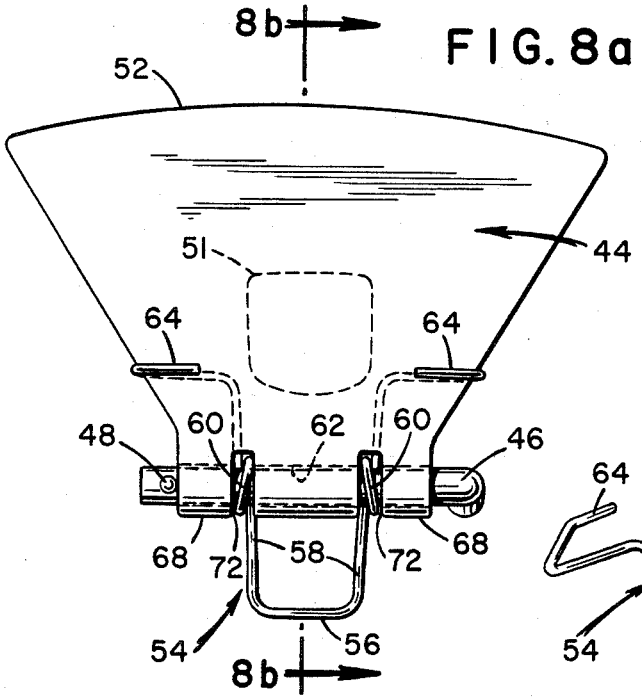
FIG. 8*a* is a plan view of one of the scraping elements.
Figure 8B:
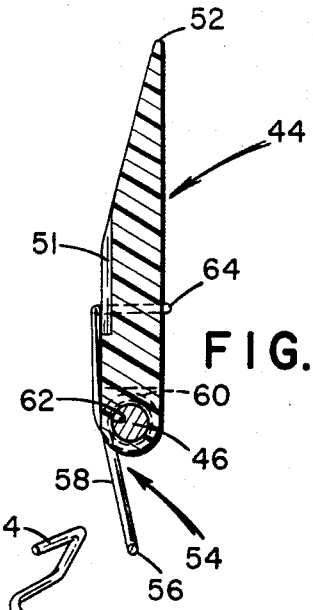
FIG. 8*b* is an elevational view of section of the scraping element of FIG. 8*a* taken along line 8—8.
Figure 8C:
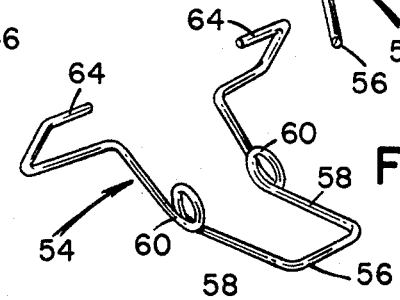
FIG. 8*c* is a perspective view of a spring which mounts to the scraping element.

The scrapers 44 are also seen in FIGS. 8*a* and 8*b* to comprise a lower body portion 68 which is arcuate at lower surfaces thereof and through which the pin-receiving channel 62 extends. The scraper 44 is seen to taper outwardly on its planar faces and to have the terminating arcuate outer edge 52 which actually contacts the walls 16 of the kettle 12 to scrape same. As seen in section in FIG. 8*b*, the scraper 44 also tapers transversely to said planar faces at a location above the lower body portion to a relatively lesser thickness at the edge 52. As best seen in FIG. 8*a*, cut-out portions 72 formed in the lower body portion 68 receive the circular portions 60 of the spring 54 to allow the pin 46 to be received through both the channel 62 formed in the scraper and the aligned circular portion 60 of the spring. While the scraper 44 may be otherwise configured, the structure shown herein is of particular utility, the one-piece molded construction facilitating cleaning as well as being relatively inexpensive to fabricate.

Referring now to FIGS. 1, 2 and 3, the shaft 18 can be seen to be readily removable from the kettle 12 by means of a split shaft and coupling arrangement seen generally at 74. A stub shaft 76 is seen to extend through a sidewall of the kettle 12 and to have a semicircular split end 78 which mates with a complementary split end 80 formed on the shaft 18, the split ends 78 and 80 having alignable channels 82 formed therein through which a quick-release pin 84 can be received. A collar 86 having oppositely disposed apertures 88 formed therein is movable along the shaft 18 to surmount the split ends 78 and 80 and to allow receipt of the pin 84 through the apertures 88 and thus through the channels 82. The shaft 18 is thus held to the stub shaft 76 in a manner which allows rapid disconnection to the shaft 18 from the stub shaft 76, thereby allowing the agitator 10 to be quickly disassembled from an operative position within the kettle 12. The pin 84 can take the form of a well-known spring-loaded ball element pin wherein a button 90 is pressed in a direction longitudinally of the pin 84 to remove spring pressure from ball elements 92 located at the other end of the pin 84 and thus allow withdrawal of the pin 84 from connection with the collar 86, the shaft 18 and the stub shaft 76. Similarly, operation of the pin 84 to unload the ball elements 92 allows ready insertion of the pin 84 through the apertures 88 of the collar 86 and the aligned channels 82 of the shaft 18 and the shaft 76 to allow rapid assembly of the agitator 10 into an operating position within the kettle 12.

As seen in FIG. 2, the opposite end of the shaft 18 is provided with a circular recess 94 having a Teflon bushing 96 disposed therein, the bushing 96 having a circular recess 98 which receives cylindrical bearing element 100 of the bearing 20 which extends from a base portion 102 welded on its opposite planar face to the inner wall 16 of the kettle 12. The shaft 18 can thus be readily slipped from engagement with the toe bearing 20 for readily removal of said shaft 18 from the kettle 12. The agitator 10 can therefore be quickly assembled and disassembled from within the kettle 12 through use of the coupling arrangement 74, tools not being required for such assembly or disassembly.

Referring again to FIGS. 1 and 3, a channel 104 is provided in the stub shaft 76 for receiving a second quickrelease pin 106 which can be substantially identical in structure to the pin 84. The pin 106 provides structure against which a coil spring 108 can exert force at one end thereof, the other end of the coil spring 108 applying pressure against a Teflon stuffing box bushing 110 which is disposed about the stub shaft 76 at the interface of said shaft 76 and the kettle 12, thereby providing a sealing of the kettle 12 at the point of entry of the stub shaft 76 thereinto. The pin 106 can conveniently be omitted by forming the collar 86 in a greater length or choosing a longer spring 108 (or both). A stuffing box (not shown) of which the stuffing box bushing 110 is a part essentially provides a double seal for liquid material within the kettle 12, all loads being transferred through a continuation of the stub shaft 76 to an exterior double ball bearing arrangement (not shown) which is of substantially conventional design. The double ball bearing arrangement substantially comprises of first bearing assembly (not shown) which is a flange mounted unit bolted to the exterior of the stuffing box and which is followed by a double race pillow block (not shown) followed by a gear reducer and hydraulic motor drive, such structure being mounted rigidly to the exterior of the kettle. The use of any hydraulic drive enables application of continuous torque at variable speeds and the ability to readily rotate the agitator 10 in either a clockwise or counterclockwise direction and further to maintain the speed of the agitator 10 at a desirable level conveniently between 3 rpm and 30 rpm for mixing of shear-sensitive food materials.

Figure 9:
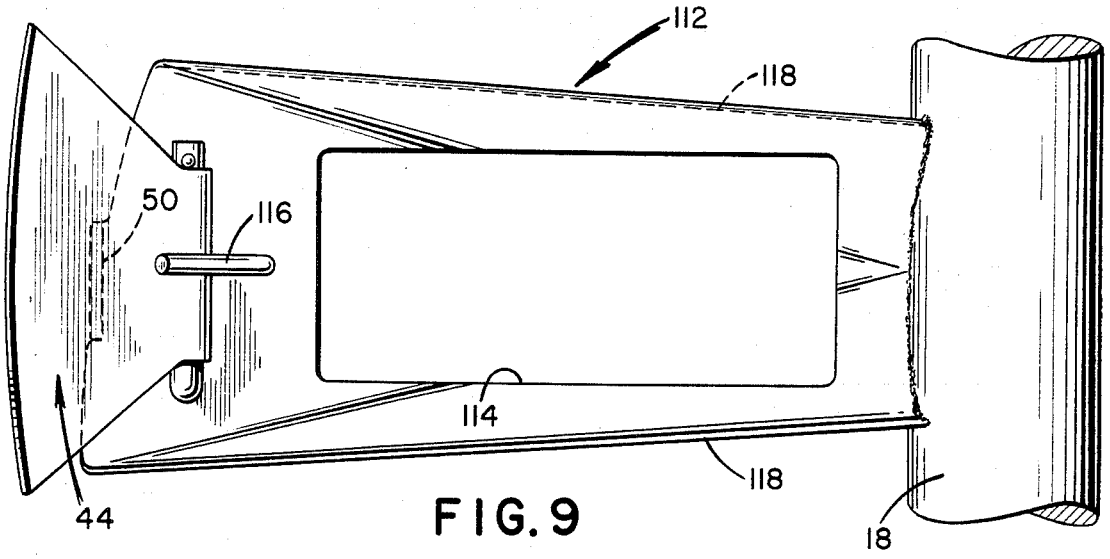
FIG. 9 is a plan view of another embodiment of a blade.
Figure 10:
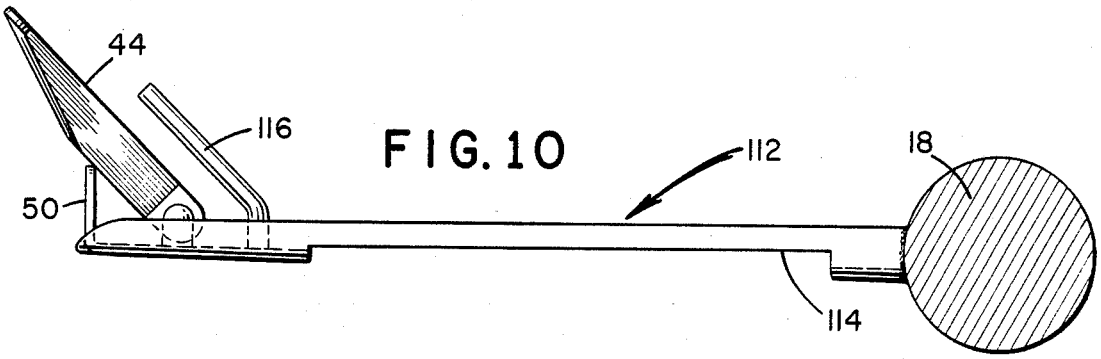
FIG. 10 is an elevational view of the agitator of FIG. 1 taken along the longitudinal axis of the agitator shaft.

Referring now to FIGS. 9 and 10, an alternate embodiment of the invention is seen to include a blade 112 which is substantially similar in structure to the blades 22 or 24 but which is provided with a substantially rectangular cutout portion 114 formed centrally thereof, the cutout portion 114 allowing a swirling of materials being mixed thereby through the portions 114 while a substantial degree of lifting due to the remaining contours of the blade 112 is still provided. Angled rods 116 are provided in this embodiment of the invention to maintain the scrapers 44 within a predetermined range of motion in association with the stops 50. It is to be understood that the rods 116 can be utilized with the blades 22, 24 and that the springs 54 could be utilized in association with the blades 112.

The blade 112 is also configured differently from the blades 22, 24 in that edges 118 which correspond to the edges 43 of the blades 22, 23 receive in opposite direction. Accordingly, one of the edges 118 is seen to extend into the plane of the drawing while the other edge 118 extends out of the plane of the drawing.

It is to be understood that the sequence of the blades 22, 24 and 28 on the shaft 18 as seen best in FIGS. 1 and 7 act to continuously move stirred material from side to side in a direction generally parallel to the longitudinal axis of the shaft 18 and essentially to the left as viewed in FIG. 1 when the lowermost blades 22 as seen in FIG. 1 are coming out of the plane of the drawing. This sidewise induced material movement combines with the "bottom to top" lifting of the materials as produced by the blades 22, 24 and 28 to thoroughly but gently mix materials contained within the kettle 12.

The mixing capability of the present agitator 10 is enhanced at least in part due to positioning of the agitator blades in opposing pairs around the shaft 18. Accordingly, when any opposing pair of blades is viewed in rotation, a combination of forces, both pulling and pushing, is realized by the given pair of blades through the mass being mixed. The rotational path of the blades uniformly distributes any heterogeneous mass throughout the spherical zone of motion while accommodating variable batch sizes as desired within the given kettle volume. Uniform torque is realized regardless of load within the kettle.

It is also to be understood that the present agitator 10 can be configured other than as explicitly described herein yet remain within the intended scope of the invention. For example, the number of the blades 22 and 24 can be varied to produce a desired structure suitable for a given mixing situation. Further, while the particular arrangement of the blades on the shaft and the particular configurations of the blades are preferred, variation can occur without departing from the scope of the invention. It is apparent to those of skill in the art that, given the above teachings, variations are possible and that the scope of the invention is defined appropriately according to the recitation of the appended claims.

We claim:

1. In a mixing apparatus including a kettle within which materials are mixed by the action of an agitator, the improvement comprising:

a rotary shaft disposed within the kettle at an angle to the vertical;

blade means carried by the shaft for displacing and lifting the materials to mix material in portions of the kettle with material in other portions thereof;

scraper means carried by the blade means for scraping inner walls of the kettle to prevent binding of the material to said inner walls and to facilitate heat transfer through said walls; and, means carried by the blade means for constantly adjusting the position of the scraper means to accommodate surface irregularities in the inner walls of the kettle and surface wear of the scraper means to maintain the scraper means in scraping relation to the inner walls of the kettle, the adjusting means comprising a pin carried by the blade means and having a portion which is spaced from the surface of the blade means and is substantially parallel thereto, the scraper means being received for pivotal movement on said portion of the pin, and, spring means carried on the portion of the pin and having a first portion which biases against the blade means and a second portion which biases against the scraper means for holding the scraper means under tension.

2. In the apparatus of claim 1 wherein the spring means comprises a unitary body of wire-like material and wherein the first portion comprises a bight portion which biases against the blade means, the bight portion including legs on each end, each leg curving at the end opposite the bight portion to form substantially circular portions within which the pin is received, the body extending outwardly from the circular portions on each side of the spring means and along each side of the scraper means on one surface thereof and curving outwardly of the scraper means and about side edges thereof to terminate in end portions which bias against a second surface of the scraper means to constitute the second portion of the spring means which biases against the scraper means.

3. In the apparatus of claim 1 wherein the scraper means are carried on each of the respective blade means to overlap the paths of each of the respective scraper means on the inner walls of the kettle.

4. In the apparatus of claim 1 wherein the shaft is disposed horizontally within the kettle.

5. In the apparatus of claim 1 wherein the blade means comprise a plurality of scoop-like elements extending radially from the shaft.

6. In the apparatus of claim 5 wherein the scoop-like elements are disposed at regular intervals along the shaft, outermost elements at respective ends of the shaft being disposed at an angle of 180° to each other, each element immediately adjacent each of the outermost elements being disposed at an angle of 120° thereto, each pair of elements immediately inwardly of each of said elements adjacent each of the outermost elements being substantially mirror images of the corresponding pair of elements across a plane taken through the longitudinal axis of the shaft and perpendicular to the longitudinal axes of the elements adjacent the outermost elements.

7. In the apparatus of claim 5 wherein the elements are carried on the shaft in positions which overlap the paths of each of the respective elements on motion within the kettle.

8. In the apparatus of claim 7 wherein the elements taper outwardly along each side edge from the shaft to effect overlap of said paths.

9. In the apparatus of claim 5 wherein at least certain of the elements are elongated and blade-like in conformation and each comprise a substantially triangular interior portion with the apex thereof adjacent the shaft and having lateral portions on each side of the triangular interior portion extending laterally of the shaft, the lateral portions rising above the plane of the triangular interior portion to form a cup-like depression on at least one major face of each of said elements.

10. In the apparatus of claim 9 wherein the scraper means are mounted to the ends of the scoop-like elements on that face of each element on which the lateral portions and the triangular interior portion form the cup-like depression.

11. In a mixing apparatus including a kettle within which materials are mixed by the action of an agitator, the improvement comprising:

a rotary shaft disposed within the kettle at an angle to the vertical; and, blade means carried by the shaft for lifting and displacing the materials to mix materials in portions of the kettle with materials in other portions thereof, the blade means comprising a plurality of blade-like elements which extend radially from the shaft, the elements being disposed at intervals along the shaft, outermost elements at respective ends of the shaft being disposed at an angle of 180° to each other, the element immediately adjacent each of the outermost elements being disposed at an angle of 120° thereto, each pair of elements immediately inwardly of each of said elements adjacent each of the outermost elements being substantially mirror images of the corresponding pair of elements across a plane taken through the longitudinal axis of the shaft and perpendicular to the longitudinal axes of the elements adjacent the outermost elements.

12. In the apparatus of claim 11 wherein the blade means comprise a plurality of scoop-like elements extending radially from the shaft.

13. In the apparatus of claim 12 wherein the scoop-like elements are disposed at regular intervals along the shaft.

14. In a mixing apparatus including a kettle within which materials are mixed by the action of an agitator, the improvement comprising:

a rotary shaft disposed within the kettle at an angle to the vertical; and, blade means carried by the shaft for lifting and displacing the materials to mix materials in portions of the kettle with materials in other portions thereof, the blade means comprising a plurality of blade-like elements which extend radially from the shaft, the elements being disposed at intervals along the shaft, outermost elements at respective ends of the shaft being disposed at an angle of 180° to each other, the element immediately adjacent each of the outermost elements being disposed at an angle of 120° thereto, the two elements immediately inwardly of each of said elements adjacent each of the outermost elements being disposed at respective angles of 60° and 180° to the outermost element located on the same end of the shaft.

15. In the apparatus of claim 14 wherein the blade means comprise a plurality of scoop-like elements extending radially from the shaft.

16. In the apparatus of claim 15 wherein the elements are carried on the shaft in positions which overlap the paths of each of the respective elements on motion within the kettle.

17. In the apparatus of claim 16 wherein the elements taper outwardly along each side edge from the shaft to effect overlap of said paths.

18. In the apparatus of claim 17 wherein at least certain of the elements are elongated and blade-like in conformation and each comprise a substantially triangular interior portion with the apex thereof adjacent the shaft and having lateral portions on each side of the triangular interior portion extending laterally of the shaft, the lateral portions rising above the plane of the triangular interior portion to form a cup-like depression on at least one major face of said element.

19. In the apparatus of claim 14 wherein the improvement further comprises:

scraper means carried by the blade means for scraping inner walls of the kettle to prevent binding of the material to said inner walls.

20. In the apparatus of claim 19 wherein the improvement further comprises:

means mounted near distal ends of at least certain of the blade means for constantly maintaining the scraper means in a scraping relation to the inner walls of the kettle.

21. In the apparatus of claim 19 wherein the improvement further comprises spring means carried by the scraper means and biasing against at least a portion of the blade means for maintaining the scraper means in a position contacting the inner walls of the kettle.

22. In the apparatus of claim 19 wherein the scraper means are carried on each of the respective blade means to overlap the paths of each of the respective scraper means on the inner walls of the kettle.

23. In the apparatus of claim 14 wherein the shaft is disposed horizontally within the kettle.

24. In a mixing apparatus including a kettle within which materials are mixed by the action of an agitator, the improvement comprising:

a rotary shaft disposed within the kettle at an angle to the vertical; and, blade means carried by the shaft for lifting and displacing the materials to mix material in portions of the kettle with material in other portions thereof, the blade means comprising a plurality of scoop-like elements which extend radially from the shaft, each scoop-like element having surface portions along the full length of the blade means which face in the direction of rotation, the surface portions being formed over the entire length of the blade means into a conformation capable of acting as a scoop to lift and displace the materials, the scoop-like elements being disposed at regular intervals along the shaft, outermost elements at respective ends of the shaft being disposed at an angle of 180° to each other, each element immediately adjacent each of the outermost elements being disposed at an angle of 120° thereto, each pair of elements immediately inwardly of each of said elements adjacent each of the outermost elements being substantially mirror images of the corresponding pair of elements across a plane taken through the longitudinal axis of the shaft and perpendicular to the longitudinal axes of the elements adjacent the outermost elements.

25. In the apparatus of claim 24 wherein the elements are carried on the shaft in positions which overlap the paths of each of the respective elements on motion within the kettle.

26. In the apparatus of claim 25 wherein the elements taper outwardly along each side edge from the shaft to effect overlap of said paths.

27. In the apparatus of claim 26 wherein at least certain of the elements are elongated and blade-like in conformation and each comprise a substantially triangular interior portion with the apex thereof adjacent the shaft and having lateral portions on each side of the triangular interior portion extending laterally of the shaft, the lateral portions rising above the plane of the triangular interior portion to form a cup-like depression on at least one major face of said element.

28. In a mixing apparatus including a kettle within which materials are mixed by the action of an agitator, the improvement comprising:

a rotary shaft disposed within the kettle at an angle to the vertical; and, blade means attached to the shaft at inner ends and extending outwardly of the shaft for displacing and lifting the materials to mix materials in portions of the kettle with materials in other portions thereof, at least certain of the blade means tapering outwardly along each side from the shaft to the outer end of the blade means, the blade means being wider at the outer ends than at the inner ends adjacent the shaft, thereby to effect overlap of the paths of the blade means on motion within the kettle, the blade means comprising a plurality of scoop-like elements extending radially from the shaft, the scoop-like elements being disposed at regular intervals along the shaft, outermost elements at respective ends of the shaft being disposed at an angle of 180° to each other, each element immediately adjacent each of the outermost elements being disposed at an angle of 120° thereto, each pair of elements immediately inwardly of each of said elements adjacent each of the outermost elements being substantially mirror images of the corresponding pair of elements having a plane taken through the longitudinal axis of the shaft and perpendicular to the longitudinal axes of the elements adjacent the outermost elements.

* * * * *